United States Patent [19]

de la Concha

[11] 4,003,177

[45] Jan. 18, 1977

[54] HERMETICALLY SEALED SECTIONAL AND DETACHABLE PROTECTIVE COVERS

[76] Inventor: Francisco de la Concha, Refineria 18 de Marzo casa No. 21, Mexico 16, Mexico City, Mexico

[22] Filed: Apr. 21, 1975

[21] Appl. No.: 569,654

Related U.S. Application Data

[63] Continuation of Ser. No. 401,963, Sept. 28, 1973, abandoned, which is a continuation of Ser. No. 187,089, Oct. 6, 1971, abandoned.

[30] Foreign Application Priority Data

Oct. 8, 1970 Mexico ..... 122,590

[52] U.S. Cl. ..... 52/630; 52/466; 52/520; 52/530

[51] Int. Cl.[2] ..... E04C 2/32

[58] Field of Search ..... 52/466, 520, 530, 630

[56] References Cited

UNITED STATES PATENTS

| | | | |
|---|---|---|---|
| 2,117,092 | 5/1938 | Guiterman | 52/630 X |
| 2,436,543 | 2/1948 | Blaski | 52/630 |
| 2,735,383 | 2/1956 | Gerbracht | 52/466 |
| 3,093,216 | 6/1963 | Dunham | 52/630 X |
| 3,111,788 | 11/1963 | Ouellet | 52/630 X |
| 3,228,159 | 1/1966 | Vecchiarelli et al. | 52/530 X |
| 3,395,438 | 8/1968 | Sceff | 52/630 X |
| 3,453,794 | 7/1969 | Blok | 52/466 |

FOREIGN PATENTS OR APPLICATIONS

| | | | |
|---|---|---|---|
| 1,127,528 | 8/1956 | France | 52/520 |
| 655,764 | 1/1938 | Germany | 52/530 |
| 599,317 | 10/1959 | Italy | 52/520 |
| 29,637 | 1906 | United Kingdom | 52/520 |

*Primary Examiner*—Alfred C. Perham
*Attorney, Agent, or Firm*—Roylance, Abrams, Berdo & Kaul

[57] ABSTRACT

A hermetically sealable sectional structural cover free of perforations and comprising a longitudinally extending planar web portion with upstanding side flange portions, the flange portions having lateral portions extending inwardly over the web portion from the tops thereof, and corrugations extending transversely along the web portion, along the flange portions and along the lateral portions but terminating short of the free edges of the lateral portions.

1 Claim, 8 Drawing Figures

HERMETICALLY SEALED SECTIONAL AND DETACHABLE PROTECTIVE COVERS

This is a continuation of application Ser. No. 401,963, filed Sept. 28, 1973, and now abandoned, which is a continuation of application Ser. No. 187,089, filed Oct. 6, 1971, and now abandoned.

BACKGROUND OF THE INVENTION

The present invention relates to improvements in sectional and detachable, hermetically sealed, protective covers, to be used in roofs, walls, floor structures, for substituting soffit scaffolding, in the construction of silos, vaults, tanks, retention walls, etc.

Covers of this type presently on the market have the disadvantage of requiring perforation to accommodate anchor means by which they must be attached to structures providing support therefor. The attendant increase in labor and irregularity in the impermeability of existing covers of this type, their high weight, especially if it is necessary to cover large surfaces are additional disadvantages. The present invention is intended to eliminate all these inconveniences mentioned in connection with known covers of this type.

SUMMARY OF THE INVENTION

This invention relates to hermetical covers that are characterized in that they are constituted by units formed of sheets or cast, forged or founded pieces which may be placed in juxtaposition, joined by means of lateral clips with which they are provided. They may be placed horizontally, vertically or in inclinations, according to the requirements of the work or construction wherein they are employed.

DETAILED DESCRIPTION OF THE INVENTION

Figure 1:
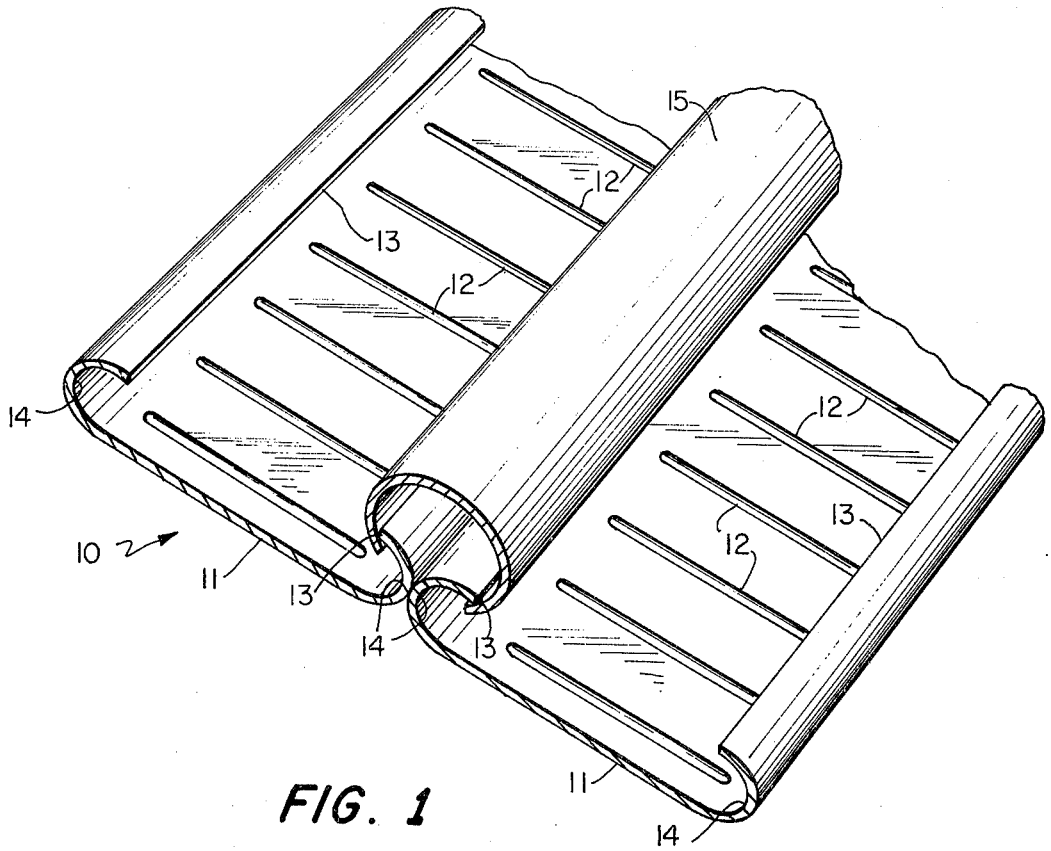
FIG. 1 is a view in perspective of the preferred embodiment of the covering assembly according to this invention.
Figure 6:
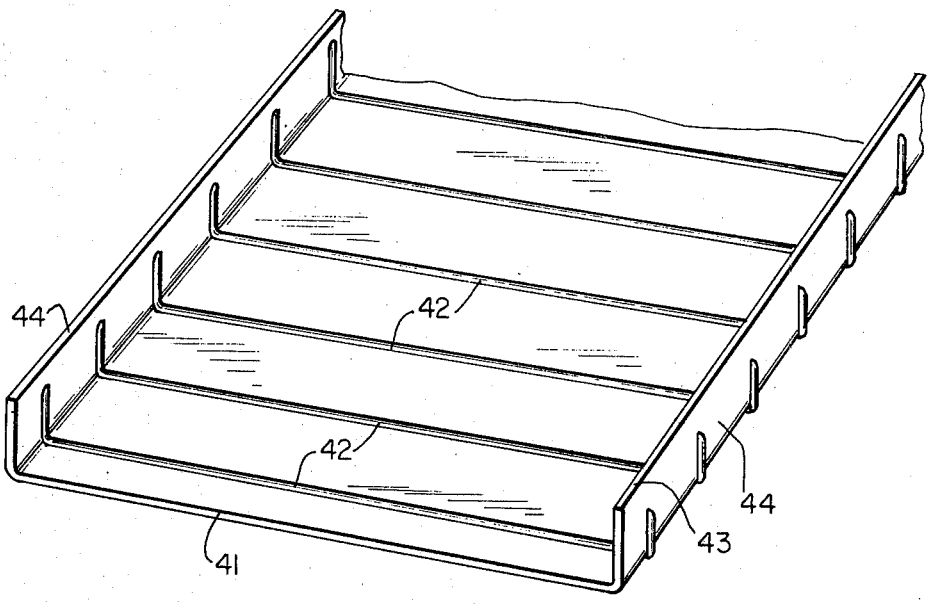
FIGS. 5–8 show various forms which the sectional cover members may take according to this invention.
Figure 7:
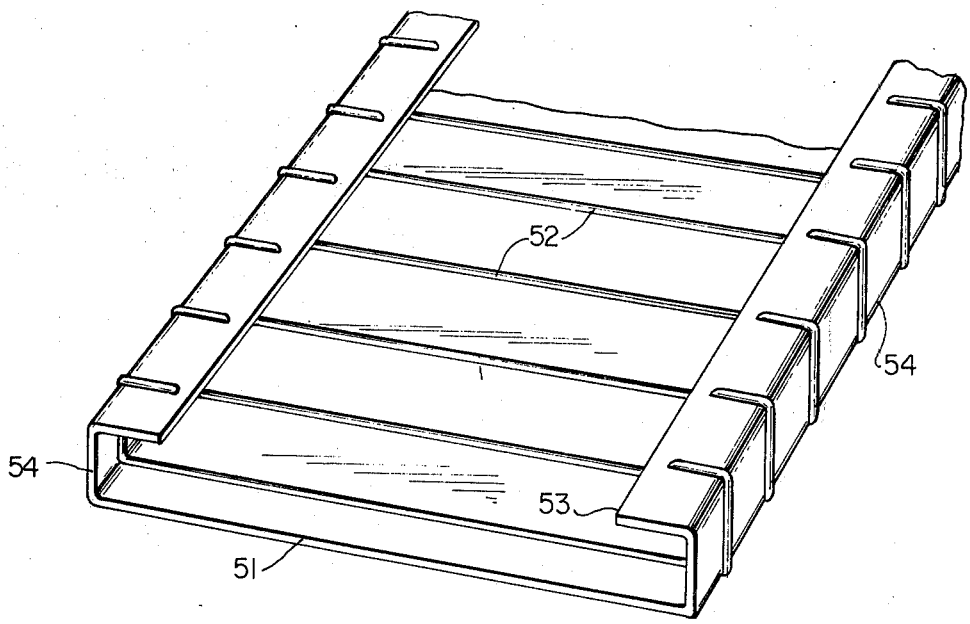
Figure 5:
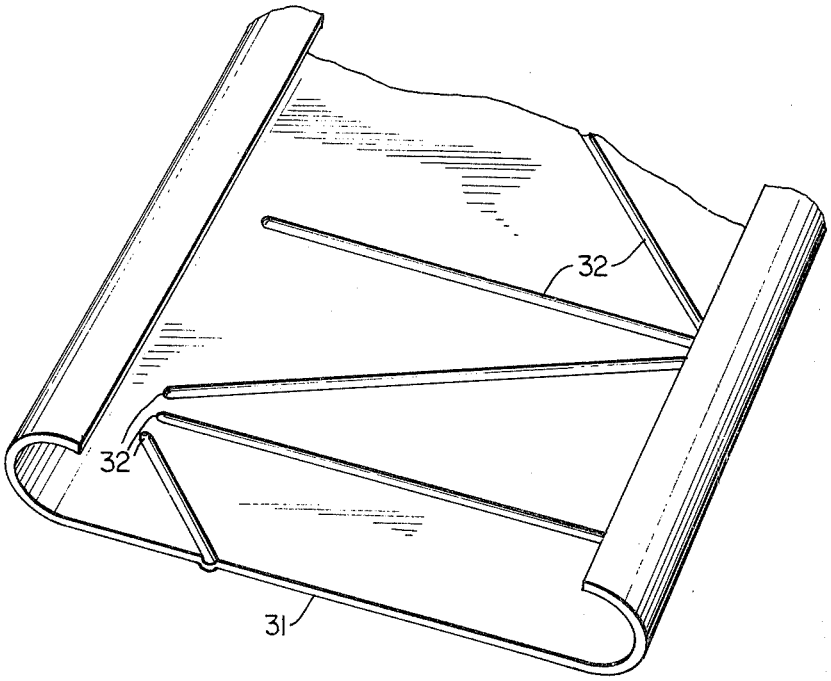
Figure 8:
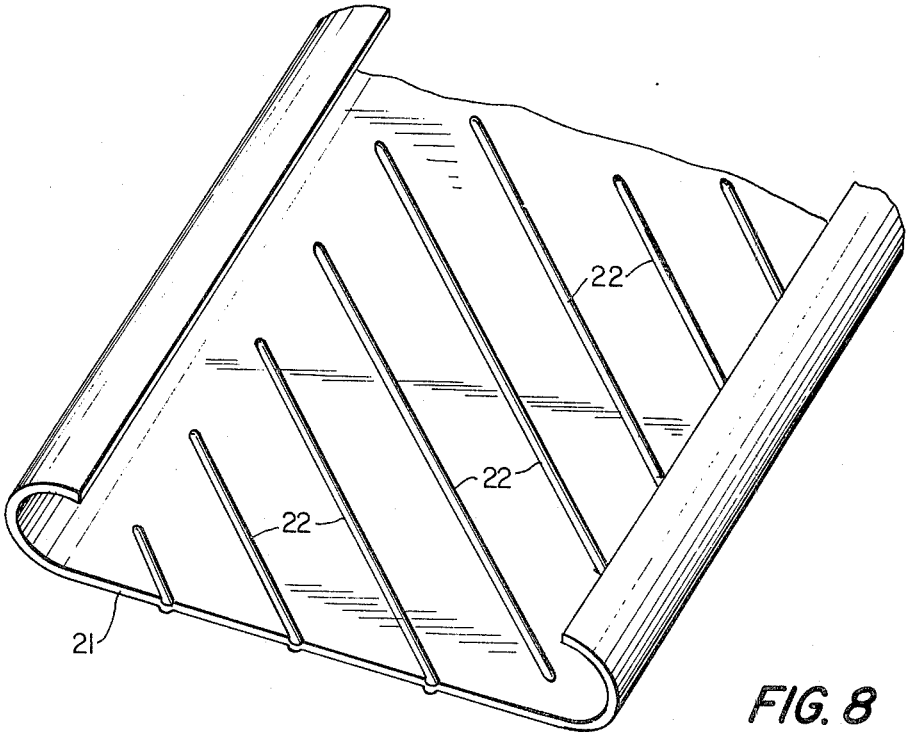

The units which together form the cover 10 are constituted by cast or forged pieces 11, having a generally rectangular shape, as seen in FIG. 1. Each sheet or piece 11 includes a surface with a series of corrugations 12 extending transversely. Alternatively, a series of corrugations 22 may extend diagonally in the surface of a piece 21 as shown in FIG. 8. Also, a combination of corrugations in various directions may be provided in piece 31 according to FIG. 5. Such corrugations 32 may extend from one side to the other, of the flat surface of the cover. Moreover, such corrugations as 42 or 52 may reach to the edge of the sheet 41 or 51, respectively, and form part of the fold or bend 44 or 54 as shown in FIGS. 6 and 7, to effect a reinforcement therefore, transmit the stress towards the lips 43 or 53 extending at both sides of the pieces 41 or 41 corresponding to lip 13 of piece 51 of FIG. 1. Such features serve a double purpose. They serve as a stress-supporting beam as well as a sealing profile.

Amplifying further on the characteristics of channel-like sheets 41 or 51 which are formed with corrugations 42 or 52 thereon, respectively, as seen in FIGS. 6 and 7, it is noted, for example, that because of the longitudinally-spaced, generally traversely extending corrugations 42, channel-like sheet 41 is inherently provided with a significant measure of flexibility whereby it may be readily deformed in a direction normal to the plane of the longitudinally extending web portion or bottom surface thereof. The corrugations 42 further inherently impart a significant measure of rigidity to sheet 41 to reinforce it against compression loading in the direction in which the corrugations 42 extend both in the web portion of sheet 41 and in the flange portions 44. Similarly, increased resistance to compression loading is provided in the channel-like sheet 51 of FIG. 7 in the web portion thereof as well as in the flange portions 54 and the inwardly directed portions at the upper edges thereof by corrugations 52. Moreover, significantly improved flexibility is imparted to sheet member 51 in the direction normal to the plane of the web portion or bottom surface thereof to facilitate deformation of member 51 whereby it may, for example, be conformed to the surface of a cooperating support member having an arcuate contour. In this connection it is clear that sheet 51 may be readily bent upwardly or downwardly of the plane of the bottom surface thereof and that depending upon the direction of bending, portions of member 51 disposed radially inwardly of the bent member will be in compression while portions disposed radially outwardly of the bent member will be in tension so that deformation of member 51 may be likened to the appearance of an accordion.

This last function is obtained in the following manner: the lip 13 which, per se, is constituted by a semicircular fold or band 14, or also an angular fold, extending completely along the piece and which results, when placed beside another similar piece, in the formation of a profile having approximately the shape of a T, as seen in FIG. 1, upon which another piece 15 will be placed, which will in length be equivalent to that of the pieces 11 that are going to be joined and which will serve as a protection so as to prevent the passage of the elements towards the interior, and which can have among other shapes that of a semi-cylindrical groove, which at the same time as it covers the joint hermetically, contributes to maintain them in joined relationship.

Figure 2:
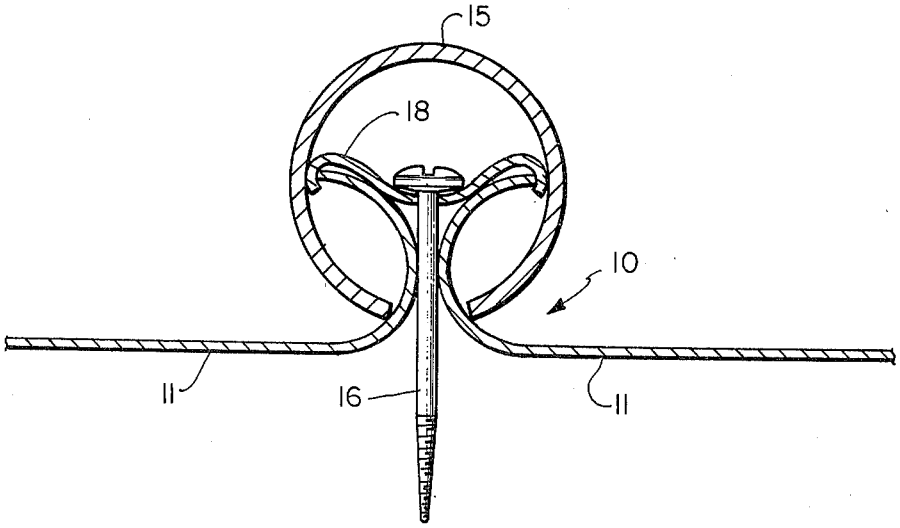
FIG. 2 is an end view in elevation of the assembly of FIG. 1 showing supplemental anchoring means to provide added rigidity to the assembly of the present invention.

The principal union is achieved by way of piece 15 which functions as a coupling member and passes over the central part of the two pieces 11 and further surrounds the lips 13 of both pieces like an inverted anchor but without perforating them. Coupling piece 15 thus firmly joins two cover pieces 11 and seals them against water and wind by its being attached to the structure or the corresponding support points. Additionally, anchor screws 16 are provided along the surface of the pieces 11, as shown in FIG. 2, in pressure relationship therewith to effect stiffness and optimum hermeticity in the arrangement. With the cover pieces 11 reinforced by the transverse slots 12 which impart thereto a degree of stiffness along with that provided by coupling piece 15 and anchor screws 16, no additional supplementary anchors such as are used by covers on the market, some of which are attached on the surface, are required.

The anchor screw 16 as seen in FIG. 2 is within the interior of the arrangement of the coupling piece 15 and cover pieces 11. The anchor screw 16 is applied to the cover pieces 11 in combination with an element in the form of a double nail 18, opposite ends of which extend around lips 13 of the cover pieces 11.

Figure 3:
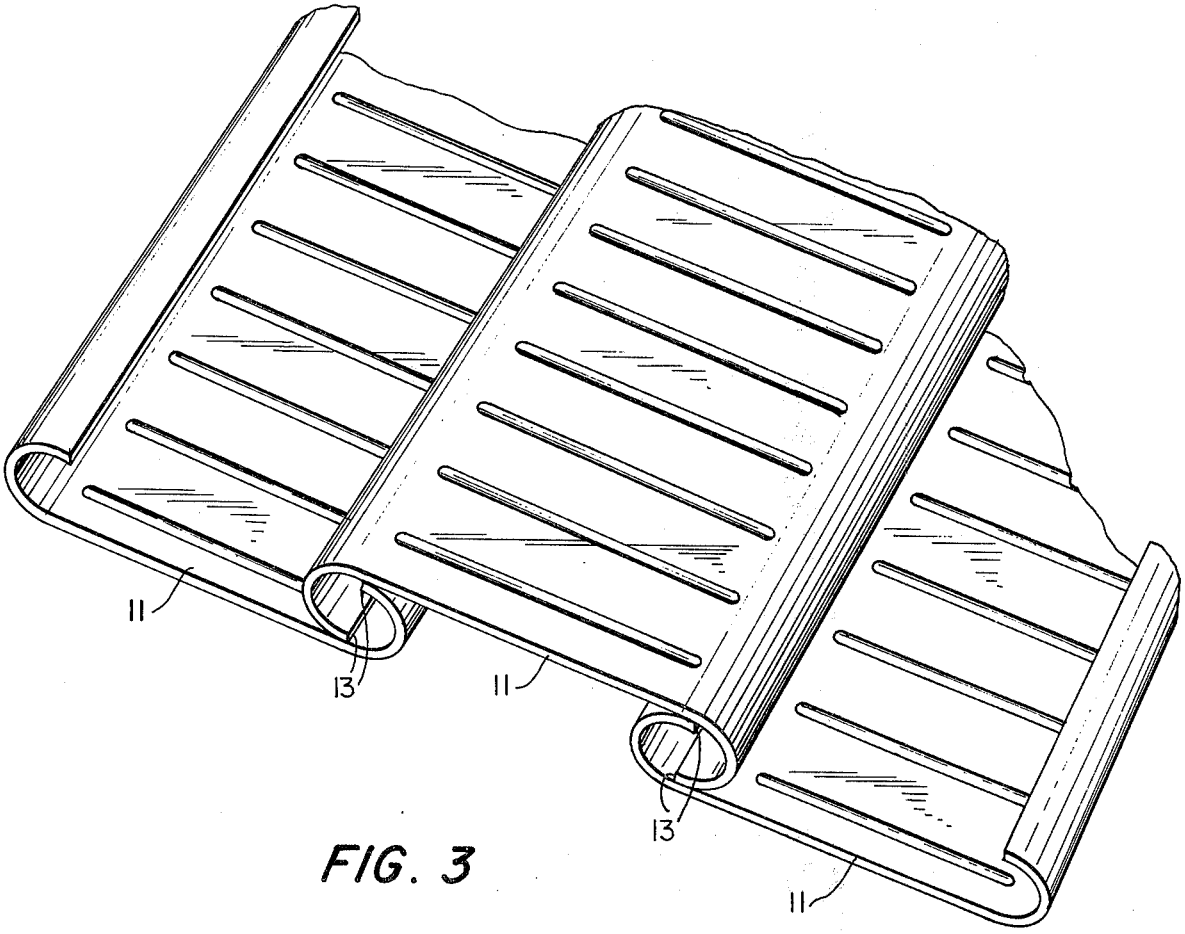
FIG. 3 is a view in perspective of an alternative arrangement of the assembled sections according to this invention.
Figure 4:
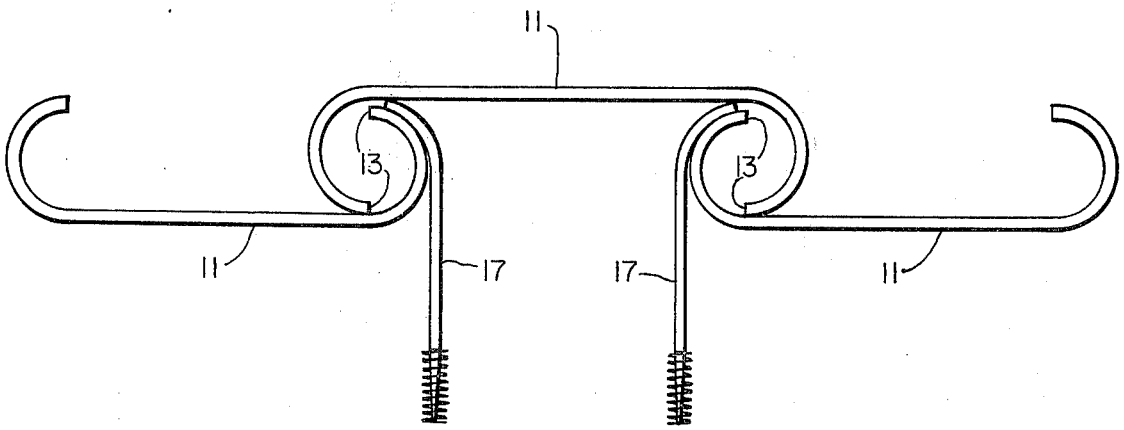
FIG. 4 is an end view in elevation of the assembly of FIG. 3 showing the anchoring means therefor.

The pieces 11 may also be interconnected with a piece 11 disposed by its two lips 13 upwards, while the next piece 11 is hooked thereto its lips 13 downwards, and so on, in a successive manner, until covering the surface as required, as shown in FIG. 3. In this manner, an anchor 17 will be needed having the shape of a hook as shown in FIG. 4, in surrounding relationship with the lip of the piece 11 that is viewing downwards. In case one wishes to impart a higher stiffness and hermeticity to the cover, it is possible to join the pieces by their lips by means of screws, soldering or with rivets, or also by a butt cover strip under pressure. The covers achieved in this manner, will have, among others, the advantages of not permitting the passage of water or other elements to accumulate and effecting a seal requiring neither permeabilizing material packings nor caulking welds.

Thus according to this invention no perforations are needed in the anchor members for the purpose of fixing it to the cover element, as would be useful for locating the anchor in known joints. Further, no transverse union or joint is needed for completing pieces of a certain length, i.e., it is possible to place pieces of a length equal or greater than the distance that exists between the ends of the part to be covered due to its great stiffness. No specific construction or special expansion joints of a supplementary nature are needed, to those formed by the profile of the lips. At the same time this invention permits in joining the lips of the covers that they serve as charge-elements or charge- or load-supporting beams, as a result of which considerably fewer support elements are required so that an economy is obtained both in time and in money. It should be pointed out that the longitudinal lips 13 of each piece 11 will have a camber proportional to the pitch thereof, to the surface to be covered and/or the weight to be supported.

It is to be understood that various changes may be made by those skilled in the art without departing from the scope of the invention, which is not to be considered limited to what is shown in the drawings and described in the specification.

What is claimed is:

1. In a hermetically sealable sectional structural cover member in the form of a channel-like plate, said member being free of perforations and comprising a longitudinally extending substantially planar web portion with upstanding, substantially planar longitudinal flange portions integral with and extending along opposite sides of said web portion, the improvement comprising:

two substantially planar lateral portions, the first one extending inwardly from the top of one of said flange portions and being integral therewith, and the second one extending inwardly from the top of the other of said flange portions and being integral therewith, said lateral portions extending generally parallel to said web portion and overlying said web portion; and reinforcing means in the form of corrugations for reinforcing said member against compression loading in the direction of said corrugations, said corrugations extending continuously in the transverse direction along said web portion, along said upstanding longitudinal flange portions and along said lateral portions but terminating short of the free edges of said lateral portions so that said free edges form continuous straight lines over their respective lengths, thereby providing an efficacious sealing surface along these free edges, said corrugations in said web portion, said flange portions and said lateral portions also providing a significant measure of flexibility to said member to facilitate deformation thereof in a direction transverse to said corrugations.

* * * * *